US010907345B2

(12) United States Patent
Abernathy et al.

(10) Patent No.: US 10,907,345 B2
(45) **Date of Patent: *Feb. 2, 2021**

(54) STRUCTURAL SUPPORT MEMBER HAVING A TAPERED INTERFACE

(71) Applicant: Bull Moose Tube Company, Chesterfield, MO (US)

(72) Inventors: Mark Scott Abernathy, Ballwin, MO (US); Marlon Edwin Robinson, Lake Saint Louis, MO (US); Jeffrey A. Packer, Toronto (CA); James Edward Charmley, Town and Country, MO (US)

(73) Assignee: Bull Moose Tube Company, Chesterfield, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/654,945

(22) Filed: Oct. 16, 2019

(65) Prior Publication Data

US 2020/0123764 A1 Apr. 23, 2020

Related U.S. Application Data

(63) Continuation-in-part of application No. 16/166,240, filed on Oct. 22, 2018, now Pat. No. 10,676,914.

(51) Int. Cl.

| | |
|---|---|
| ***E04B 1/18*** | (2006.01) |
| ***E04B 1/61*** | (2006.01) |
| ***E04C 3/32*** | (2006.01) |

(52) U.S. Cl.
CPC . *E04B 1/54* (2013.01); *E04C 3/32* (2013.01)

(58) Field of Classification Search
CPC ..... E04B 1/2403; E04B 2001/2421; E04B 2001/246; E04B 2001/2451; E04B 2001/2418; E04B 2001/2469; E04C 3/32
See application file for complete search history.

(56) References Cited

U.S. PATENT DOCUMENTS 3,345,085 A * 10/1967 Hanes ..... F16L 37/0885 285/27
5,090,837 A * 2/1992 Mower ..... F16B 7/0413 403/334

(Continued)

FOREIGN PATENT DOCUMENTS

| | | | |
|---|---|---|---|
| CN | 104213643 | A | 12/2014 |
| JP | H10978692 | A | 3/1997 |
| WO | 2004051014 | A1 | 6/2004 |

OTHER PUBLICATIONS

Witt. Forgings—Significance, Design, Production, Application. Apr. 1, 2011 (Apr. 1, 2011). [retrieved on Jan. 6, 2018], Retrieved from the Internet. <URL: http://www.euroforge.org/fileadmin/user_upload/eLibrary/IMU_Basic_Knowledge_English_final_ 11-03-14.pdf. pp. 1-3, 20, 30, 32-37, 49, 51, 54.

(Continued)

*Primary Examiner* — Patrick J Maestri
(74) *Attorney, Agent, or Firm* — Armstrong Teasdale LLP

(57) ABSTRACT

An interface for a structural column includes a female end section that includes at least one first sidewall that extends from a first end along a longitudinal direction and defines a first cavity. An interior surface of the at least one first sidewall tapers transversely outwardly along the female end section towards the first end. The interface also includes a male end section that includes at least one second sidewall that extends from a second end along the longitudinal direction and defines a second cavity. The at least one second sidewall is configured to be received within, and oriented in substantially face-to-face adjacent relationship with, the at least one first sidewall. Each of the female end section and the male end section is a respective unitary casting.

16 Claims, 5 Drawing Sheets

(56) References Cited

U.S. PATENT DOCUMENTS

| | | | | |
|---|---|---|---|---|
| 5,907,969 | A | 6/1999 | Soder | |
| 6,151,851 | A * | 11/2000 | Carter | E04B 1/24 52/236.3 |
| 2001/0013419 | A1 | 8/2001 | Edelstein | |
| 2003/0177735 | A1 | 9/2003 | Seeba et al. | |
| 2007/0209314 | A1 | 9/2007 | Vaughn | |
| 2007/0261356 | A1 | 11/2007 | Vaughn | |
| 2008/0178551 | A1 | 7/2008 | Porter | |
| 2013/0239516 | A1 | 9/2013 | Vaughn | |
| 2014/0290154 | A1 | 10/2014 | Perko et al. | |

OTHER PUBLICATIONS

International Search Report and Written Opinion, dated Jul. 9, 2018, for related International application No. PCT/2018/025693.
International Search Report and Written Opinion, dated Oct. 27, 2017, for related International application No. PCT/2017/047337.

* cited by examiner

STRUCTURAL SUPPORT MEMBER HAVING A TAPERED INTERFACE

CROSS REFERENCE TO RELATED APPLICATIONS

This application is a continuation-in-part of, and claims priority to, U.S. application Ser. No. 16/166,240, filed Oct. 22, 2018, the disclosure of which is incorporated by reference in its entirety.

BACKGROUND

The field of the disclosure relates generally to tubular support members and, more particularly, to an interface for use in coupling together tubular support members in a building frame.

Many known building structures have a frame that includes a plurality of beams and a plurality of columns. When erecting a taller (e.g., multistory) building, it can be difficult to transport full-length columns to the building site, and it is common to instead transport each column in segments that are ultimately welded together at the building site. However, it can be time consuming and costly to weld column segments together at a building site.

BRIEF DESCRIPTION

In one aspect, an interface for a structural column is provided. The interface includes a female end section that includes at least one first sidewall that extends from a first end along a longitudinal direction and defines a first cavity. The at least one first sidewall includes an interior surface facing the first cavity. The interior surface of the at least one first sidewall tapers transversely outwardly along the female end section towards the first end. The interface also includes a male end section that includes at least one second sidewall that extends from a second end along the longitudinal direction and defines a second cavity. The at least one second sidewall is configured to be received within, and oriented in substantially face-to-face adjacent relationship with, the at least one first sidewall. The at least one second sidewall includes an interior surface facing the second cavity and an exterior surface facing outwardly opposite the interior surface. Each of the female end section and the male end section is a respective unitary casting.

In another aspect, a column for a moment-resisting frame is provided. The column includes a first hollow structural section (HSS) column segment that includes at least one first sidewall that extends along a longitudinal direction from a first end to a second end and defines a first cavity. The at least one first sidewall includes an interior surface facing the first cavity. The at least one first sidewall further defines a female end section extending longitudinally along the first HSS column segment from the first end of the first HSS column segment. The interior surface of the at least one first sidewall tapers transversely outwardly along the female end section towards the first end of the first HSS column segment. The column also includes a second HSS column segment that includes at least one second sidewall that extends along the longitudinal direction from a first end to a second end and defines a second cavity. The at least one second sidewall includes an interior surface facing the second cavity and an exterior surface facing outwardly opposite the interior surface of the at least one second sidewall. The at least one second sidewall further defines a male end section extending longitudinally along the second HSS column segment from the second end of the second HSS column segment. Each of the female end section and the male end section is a respective unitary casting.

In another aspect, a method of assembling a structural column is provided. The method includes positioning a first column segment and a second column segment with respect to each other. The first column segment includes at least one first sidewall that extends along a longitudinal direction from a first end to a second end and defines a first cavity. The at least one first sidewall includes an interior surface facing the first cavity. The at least one first sidewall further defines a female end section extending longitudinally along the first column segment from the first end of the first column segment. The interior surface of the at least one first sidewall tapers transversely outwardly along the female end section towards the first end of the first HSS column segment. The second column segment includes at least one second sidewall that extends along the longitudinal direction from a first end to a second end and defines a second cavity. The at least one second sidewall includes an interior surface facing the second cavity and an exterior surface facing outwardly opposite the interior surface of the at least one second sidewall. The at least one second sidewall further defines a male end section extending longitudinally along the second HSS column segment from the second end of the second HSS column segment. Each of the female end section and the male end section is a respective unitary casting. The method also includes inserting the male end section into the female end section such that the at least one second sidewall is oriented in adjacent, substantially face-to-face relationship with the at least one first sidewall, and at least one first fastener opening defined in the at least one first sidewall is registered with a corresponding at least one second fastener opening defined in the at least one second sidewall. The method further includes inserting at least one fastener into the registered first and second fastener openings.

DETAILED DESCRIPTION

The following detailed description illustrates tubular support members with tapered interfaces and methods of assembling the same by way of example and not by way of limitation. The description enables one of ordinary skill in the art to make and use the tubular support members, and the description describes several embodiments of the tubular support members, including what is presently believed to be the best modes of making and using the tubular support members. Exemplary tubular support members with tapered interfaces are described herein as being used to couple together support members in a building frame. However, it is contemplated that tubular support members with tapered interfaces have general application to a broad range of systems in a variety of fields other than frames of buildings.

Unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item. Unless otherwise indicated, approximating language, such as "generally," "substantially," and "about," as used herein indicates that the term so modified may apply to only an approximate degree, as would be recognized by one of ordinary skill in the art, rather than to an absolute or perfect degree. Accordingly, a value modified by a term or terms such as "about," "approximately," and "substantially" is not to be limited to the precise value specified. In at least some instances, the approximating language may correspond to the precision of an instrument for measuring the value.

Figure 1:
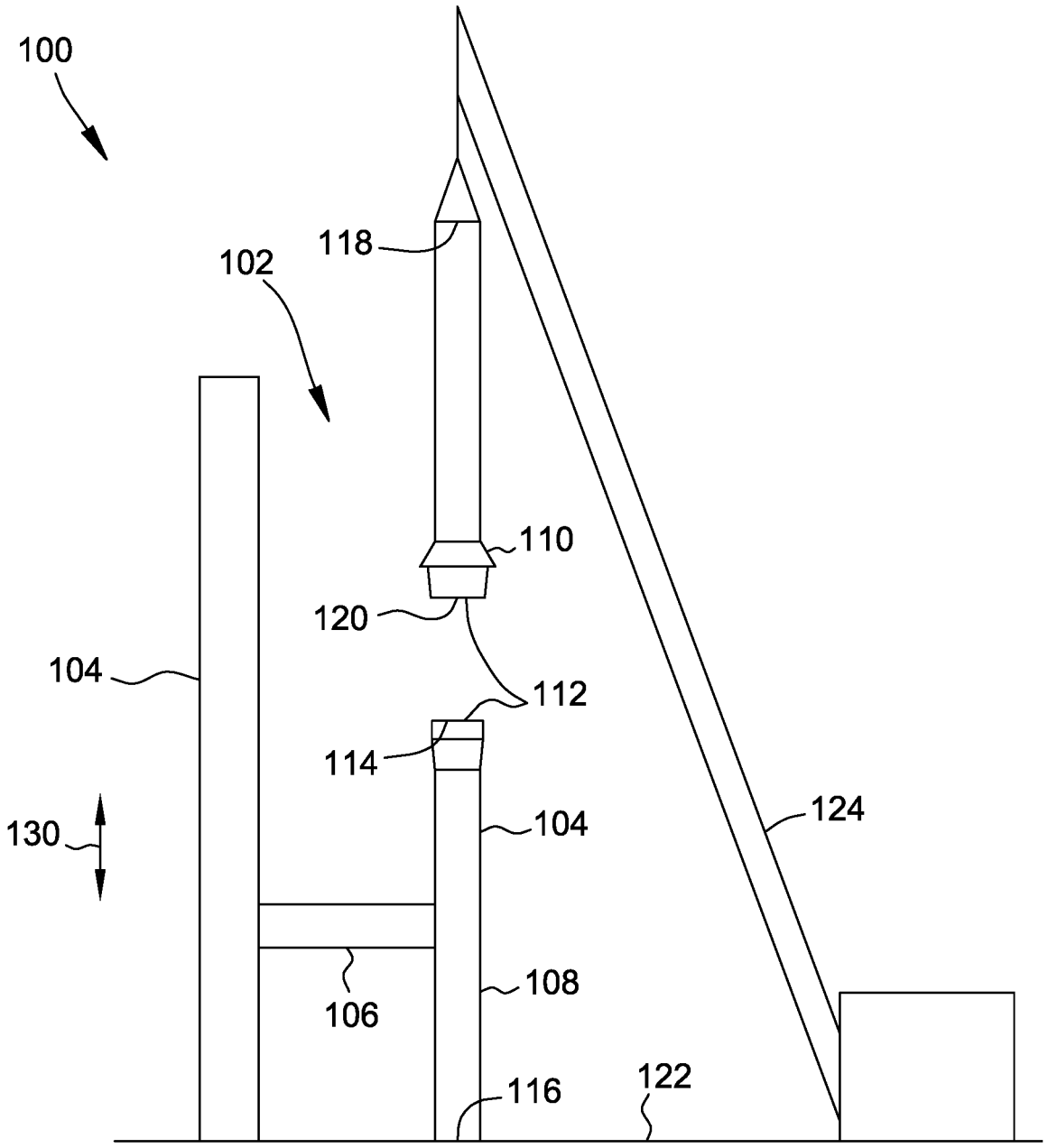
FIG. 1 is a schematic illustration of a site at which an exemplary building frame is being erected.

FIG. 1 is a schematic illustration of a site 100 at which an exemplary building frame 102 is being erected. In the exemplary embodiment, building frame 102 is a moment-resisting frame (e.g., a special moment frame or an intermediate moment frame) that includes a plurality of columns 104 that each extend substantially in a longitudinal direction 130, and a plurality of beams 106 that extend transversely between columns 104. In some embodiments, columns 104 and beams 106 are made of structural steel. In other embodiments, columns 104 and beams 106 may be made of any suitable material that facilitates enabling frame 102 to function as described herein. In the exemplary embodiment, at least one column 104 of frame 102 has a first column segment 108 and a second column segment 110 that are coupled together at a moment-resisting tapered interface 112. More specifically, first column segment 108 extends longitudinally from a first end 114 to a second end 116, and second column segment 110 extends longitudinally from a first end 118 to a second end 120. Tapered interface 112 is defined at first end 114 of first column segment 108 and at second end 120 of second column segment 110, such that at least one column 104 of frame 102 is assembled onsite by coupling its associated first column segment 108 to its associated second column segment 110 at first end 114 and second end 120, respectively, using tapered interface 112. Although first column segment 108 is illustrated as being coupled to a foundation 122 in the exemplary embodiment, first column segment 108 may be other than coupled to foundation 122 in other embodiments (i.e., first column segment 108 may have any suitable position within frame 102, including a position that is elevated above foundation 122). Moreover, although second column segment 110 is illustrated as being lifted onto first column segment 108 using a crane 124 in the exemplary embodiment, second column segment 110 may be positioned with respect to first column segment 108 using any suitable method.

Figure 2:
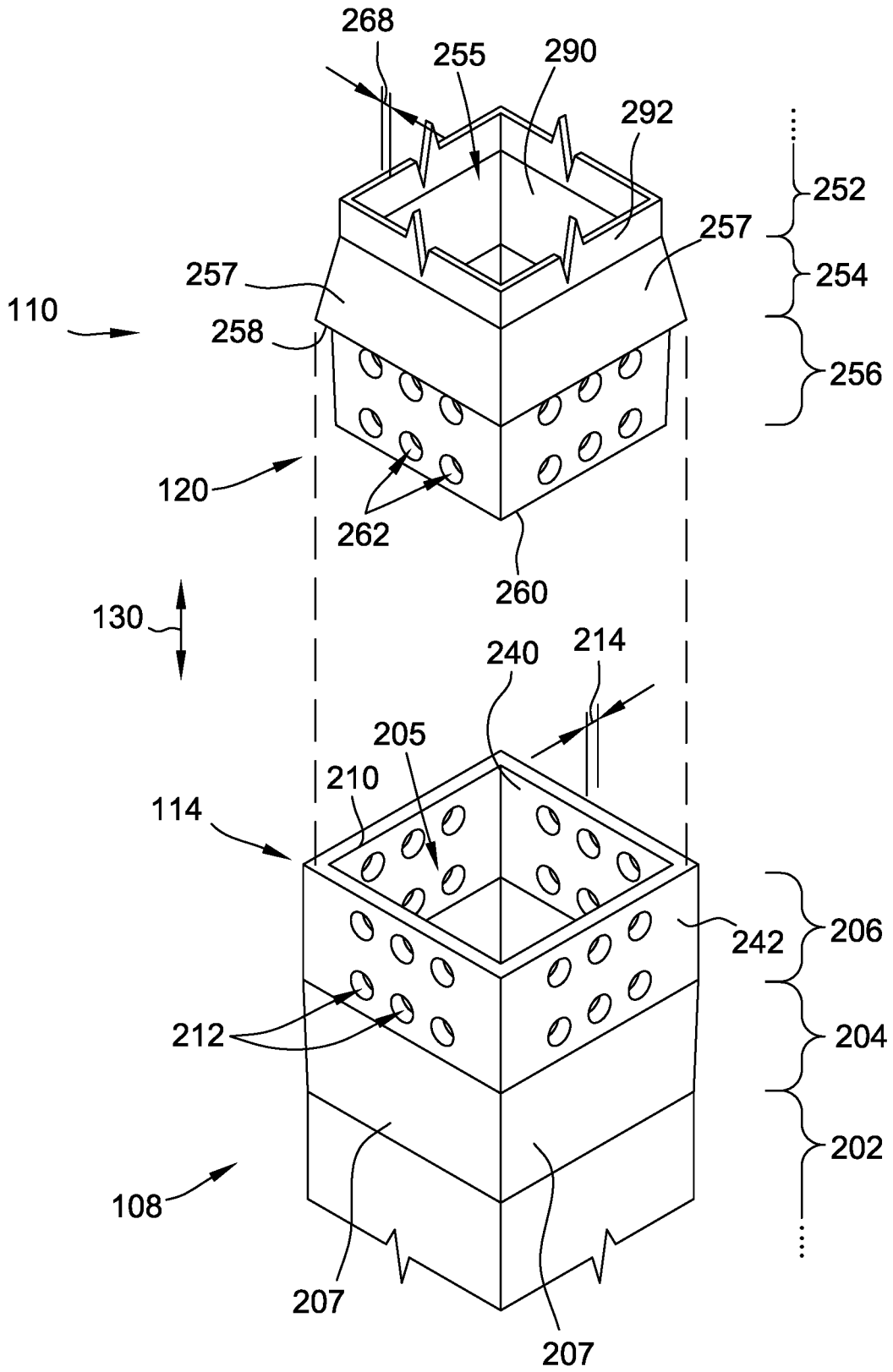
FIG. 2 is a perspective view of exemplary first and second column segments that may be used to form a column for use in the frame shown in FIG. 1.
Figure 3:
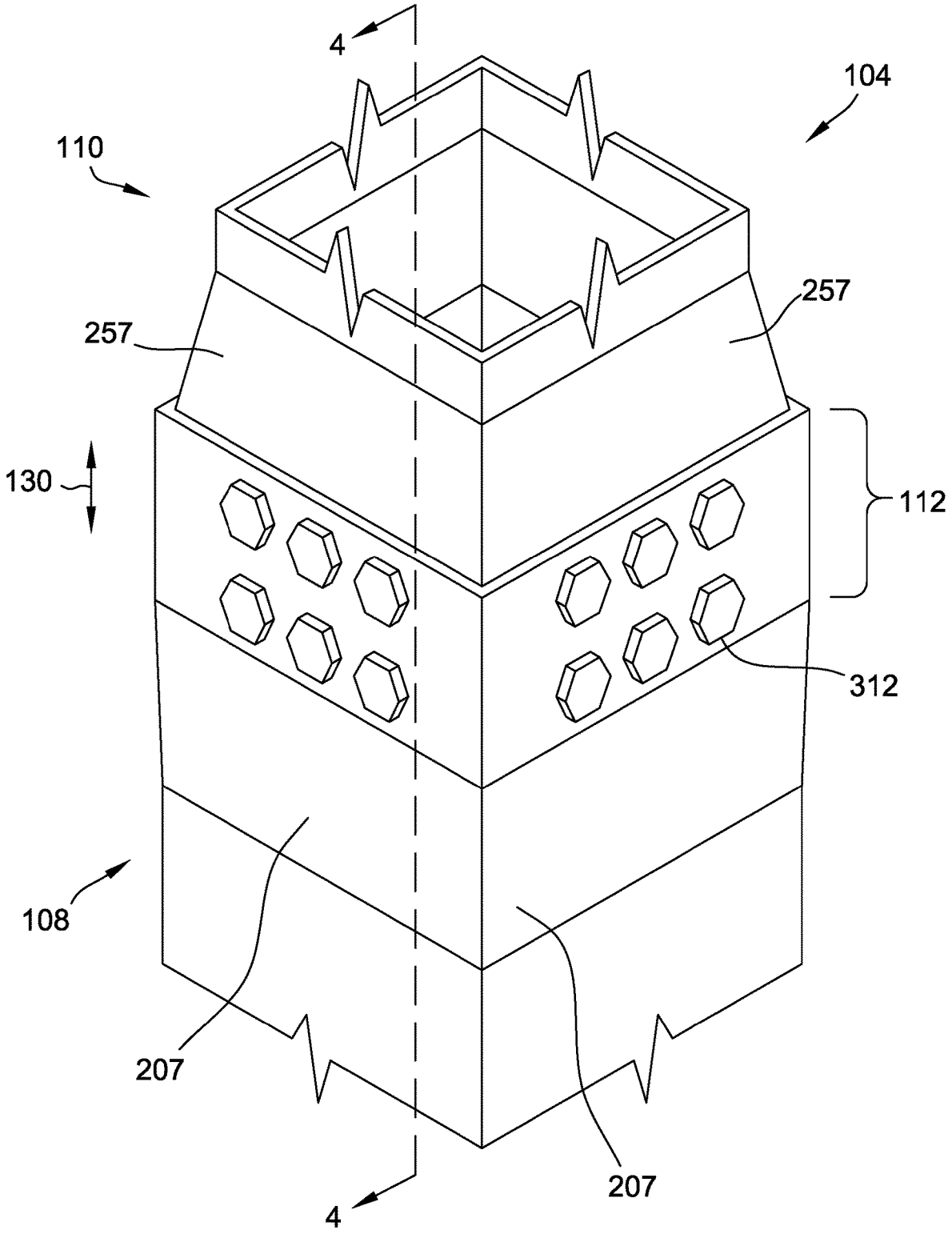
FIG. 3 is a perspective view of the first and second column segments shown in FIG. 2 assembled to form an exemplary column, such as for use in the building frame of FIG. 1.
Figure 4:
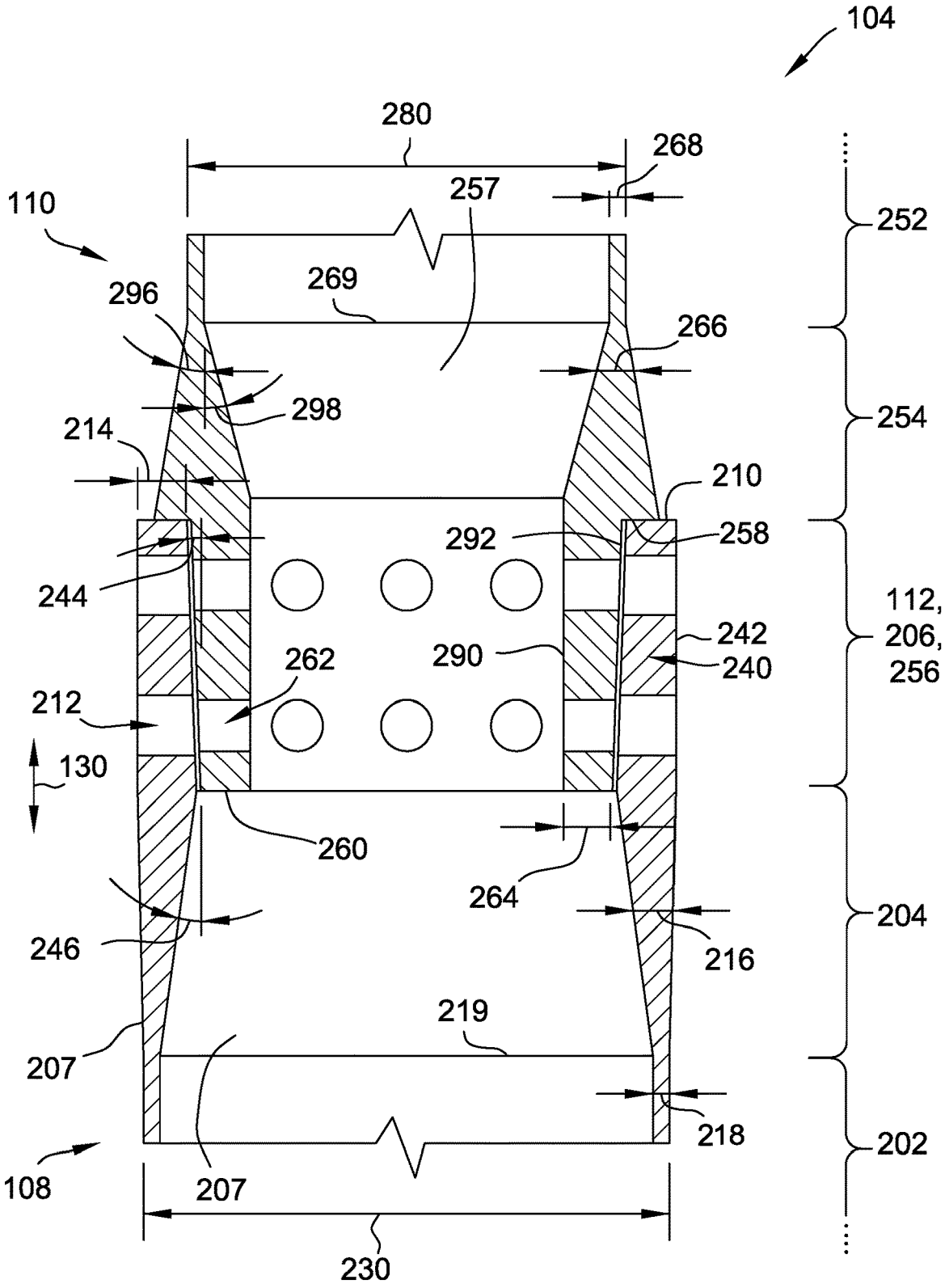
FIG. 4 is a sectional view of the assembled first and second column segments taken along lines 4-4 in FIG. 3.
Figure 5:
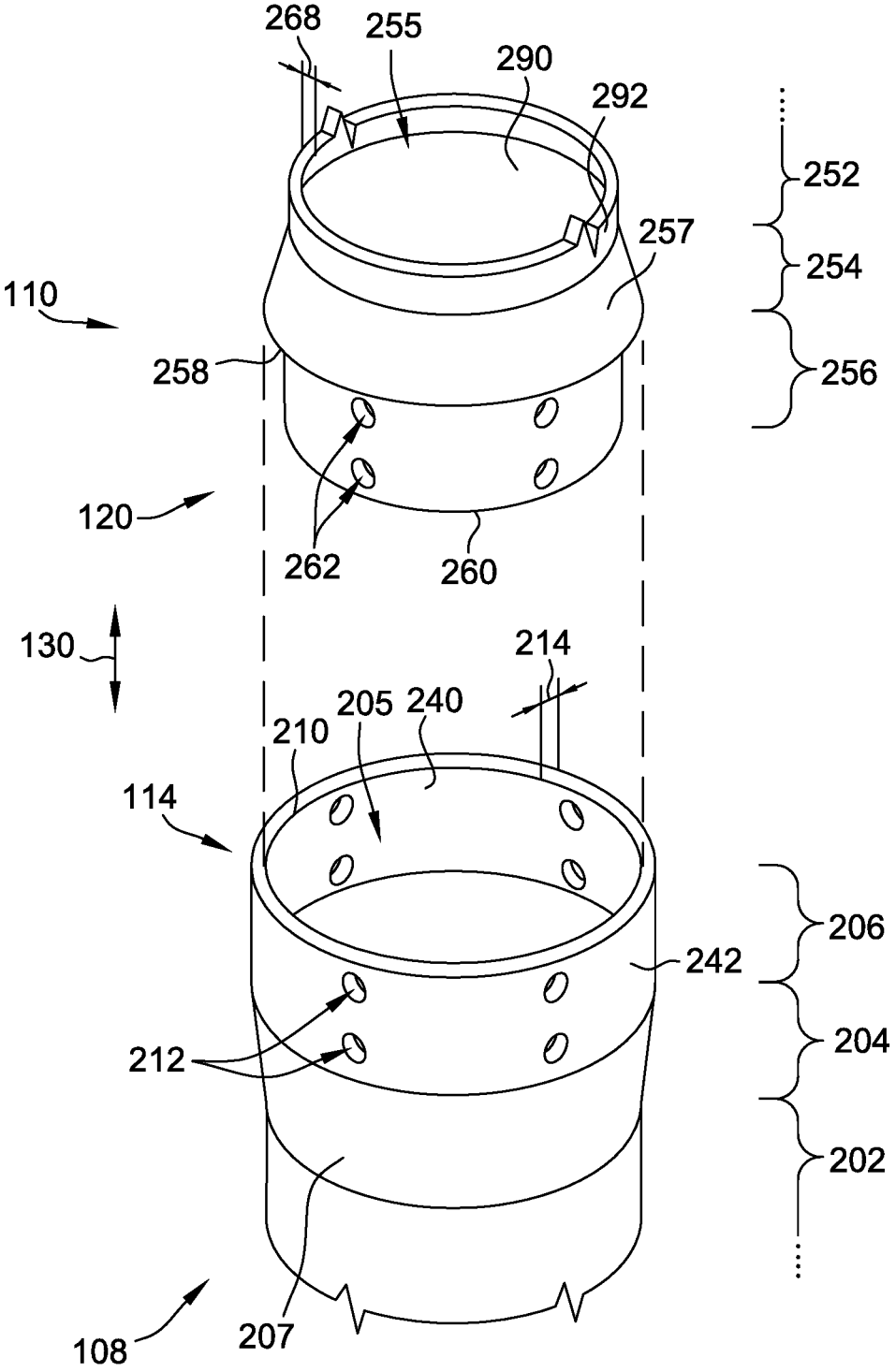
FIG. 5 is a perspective view of alternative exemplary first and second column segments that may be used to form a column for use in the frame shown in FIG. 1.

FIG. 2 is a perspective view of an exemplary embodiment of first column segment 108 and second column segment 110 in a pre-assembly configuration. FIG. 3 is a perspective view of column segment 108 and second column segment 110 assembled to form an embodiment of column 104. FIG. 4 is a sectional view of column 104 taken along lines 4-4 shown in FIG. 3. Fasteners 312 shown in FIG. 3 are omitted from FIG. 4 for clarity of illustration of other features. FIG. 5 is a perspective view of an alternative exemplary embodiment of first column segment 108 and second column segment 110 in a pre-assembly configuration, in which the first and second column segments have complementary circular cross-sections but otherwise share the features of the embodiment of FIGS. 2-4. With reference to FIGS. 1-5, first column segment 108 and second column segment 110 after assembly cooperate to define an exemplary embodiment of moment-resisting tapered interface 112 for coupling first column segment 108 to second column segment 110.

In the exemplary embodiment, each of first column segment 108 and second column segment 110 is a hollow structural section (HSS). Alternatively, first column segment 108 and/or second column segment 110 is any suitable support member. For example, in some embodiments, segments 108 and 110 are not column segments for use in frame 102, but instead are another suitable type of support member that is coupleable using interface 112 as described herein.

In the exemplary embodiment, first column segment 108 includes at least one first sidewall 207 that extends from first end 114 along longitudinal direction 130 and defines a first cavity 205. In the exemplary embodiment, first cavity 205 extends along an entire length of first column segment 108, and each of first end 114 and second end 116 is open to first cavity 205. Alternatively, first cavity 205 is interrupted along the length of first column segment 108, closed off at second end 116, or otherwise extends along less than the entire length of first column segment 108.

In the exemplary embodiment, the at least one first sidewall 207 defines, in longitudinal series from first end 114 along first column segment 108, a first end section 206, a first intermediate section 204, and a first central section 202. In alternative embodiments, at least one additional section is interposed between first intermediate section 204 and first central section 202. In other alternative embodiments, first intermediate section 204 is not included. For example, first end section 206 is directly adjacent to first central section 202. First end section 206 is also referred to herein as a female end section 206.

In the exemplary embodiment of FIGS. 2-4, the at least one first sidewall 207 includes four sidewalls 207 oriented to define a substantially rectangular hollow cross-section, in a plane normal to longitudinal direction 130, at each longitudinal station along first column segment 108. For example, in the illustrated embodiment, the four sidewalls 207 are oriented to define a substantially square hollow cross-section. Alternatively, the at least one first sidewall 207 includes any suitable number of sidewalls 207 and/or is oriented to define any suitable hollow cross-section. For example, in some embodiments, the at least one first sidewall 207 is a single, curved first sidewall 207 oriented to define a substantially elliptical or circular hollow cross-section at each longitudinal station, as shown in FIG. 5. With reference to FIGS. 2-5, in the exemplary embodiment, a size and area of the hollow cross-section defined by the at least one first sidewall 207 varies among first central section 202, first intermediate section 204, and first end section 206. Also in the exemplary embodiment, the size and area of the hollow cross-section defined by the at least one first sidewall 207 varies along first intermediate section 204 and along first end section 206, and is substantially constant along first central section 202. Alternatively, the size and area of the hollow cross-section defined by the at least one first sidewall 207 are defined along first central section 202, first intermediate section 204, and/or first end section 206 in any suitable fashion that enables interface 112 to function as described herein.

At first end 114, the at least one first sidewall 207 defines a first or female end surface 210 oriented transversely to longitudinal direction 130. In the exemplary embodiment, female end surface 210 is configured to interact with a stop surface 258 disposed on second column segment 110, as described below, to facilitate alignment and coupling of female end section 206 and male end section 256 to assemble interface 112.

The at least one first sidewall 207 includes an interior surface 240 facing first cavity 205, and an exterior surface 242 facing outwardly opposite interior surface 240. Interior surface 240 flares or tapers transversely outwardly along female end section 206 towards first end 114. In some embodiments, the outward taper of interior surface 240 along female end section 206 facilitates alignment and seating of male end section 256 within female end section 206 during assembly of interface 112. For example, in the exemplary embodiment, interior surface 240 of each first sidewall 207 along female end section 206 is oriented at a non-zero end taper angle 244, as best seen in FIG. 4, with respect to longitudinal direction 130. In some embodiments, end taper angle 244 is between about 1 degree and about 5 degrees, facilitating the alignment and seating advantages described herein while substantially maintaining a longitudinal load carrying path of column 104. For example, in some embodiments, end taper angle 244 is 2 degrees. In alternative embodiments, the at least one first sidewall 207 is tapered outwardly along female end section 206 in any suitable fashion that enables interface 112 to function as described herein.

In the exemplary embodiment, an exterior surface 242 of the at least one first sidewall 207 along female end section 206 is oriented substantially parallel to interior surface 240, such that a thickness 214 of the at least one first sidewall 207 remains constant along female end section 206. In alternative embodiments, exterior surface 242 along female end section 206 is oriented in any suitable fashion with respect to interior surface 240, and/or thickness 214 of the at least one first sidewall 207 varies along female end section 206 to any suitable extent, that enables interface 112 to function as described herein. In the exemplary embodiment, thickness 214 is greater than a thickness 218 of the at least one first sidewall 207 along first central section 202 to facilitate increased structural strength of transverse cross-sections of female end section 206 that include first fastener openings 212.

The at least one first sidewall 207 along female end section 206 includes at least one first fastener opening 212 defined therein and extending therethrough. In the exemplary embodiment, the at least one first fastener opening 212 includes a plurality of first fastener openings 212 arranged in a respective first fastener pattern on each sidewall 207 along female end section 206. For example, in the exemplary embodiment, each of the four sidewalls 207 includes a plurality of first fastener openings 212 arranged in an identical first fastener pattern. In alternative embodiments, at least one of the four sidewalls 207 includes a plurality of first fastener openings 212 arranged in a first fastener pattern that differs from the first fastener pattern of others of the four sidewalls 207, or includes no first fastener openings 212. In the exemplary embodiment, the first fastener pattern includes six first fastener openings 212 arranged in two rows each having three first fastener openings 212, and each first fastener opening 212 in each row is vertically aligned with a respective first fastener opening 212 in the adjacent row. In alternative embodiments, each first fastener pattern includes any suitable number, arrangement, and/or alignment of first fastener openings 212.

In the exemplary embodiment, interior surface 240 of the at least one first sidewall 207 flares or tapers transversely outwardly along first intermediate section 204 away from female end section 206 towards first central section 202. For example, in the exemplary embodiment, interior surface 240 of each first sidewall 207 along first intermediate section 204 is oriented at a non-zero first intermediate taper angle 246, as best seen in FIG. 4, with respect to longitudinal direction 130. In some embodiments, first intermediate taper angle 246 is between about 3 degrees and about 30 degrees, facilitating a continuous transition from increased thickness 214 of female end section 206 to thickness 218 of first central section 202 such that stress concentrations are reduced. More specifically, in some embodiments, first intermediate taper angle 246 is 10 degrees. In alternative embodiments, the at least one first sidewall 207 is tapered outwardly along first intermediate section 204 towards first central section 202 in any suitable fashion that enables interface 112 to function as described herein.

In the exemplary embodiment, exterior surface 242 of the at least one first sidewall 207 along first intermediate section 204 is oriented substantially parallel to exterior surface 242 of female end section 206, such that a thickness 216 of the at least one first sidewall 207 is continuously reduced along first intermediate section 204 as interior surface 240 tapers outwardly and stress concentrations are reduced. In alternative embodiments, exterior surface 242 along female end section 206 is oriented in any suitable fashion, and/or thickness 216 of the at least one first sidewall 207 varies along first intermediate section 204 in any suitable fashion, that enables interface 112 to function as described herein.

In alternative embodiments, first column segment 108 does not include first intermediate section 204. For example, first end section 206 is directly adjacent to first central section 202.

In the exemplary embodiment, first central section 202 extends over at least half of a total length of first column segment 108. In alternative embodiments, first central section 202 extends over any suitable portion of the total length of first column segment 108. In the exemplary embodiment, the size and area of the hollow cross-section defined by the at least one first sidewall 207 along first central section 202 is substantially constant. Moreover, a thickness 218 of the at least one first sidewall 207 along first central section 202 is substantially constant. In alternative embodiments, the size and area of the hollow cross-section defined by the at least one first sidewall 207 along first central section 202 and/or thickness 218 vary in any suitable fashion that enables first column segment 108 to function as described herein. In the exemplary embodiment, interior surface 240 and exterior surface 242 of the at least one first sidewall 207 along first central section 202 are oriented substantially parallel to each other and to longitudinal direction 130. In alternative embodiments, interior surface 240 and exterior surface 242 of the at least one first sidewall 207 along first central section 202 are oriented with respect to each other and to longitudinal direction 130 in any suitable fashion that enables first column segment 108 to function as described herein.

In the exemplary embodiment, female end section 206 and first intermediate section 204 are formed together in a molten metal (e.g., steel) casting process, resulting in a monolithic and unitarily formed casting of female end section 206 and first intermediate section 204. For example, first central section 202 is formed separately from a hollow precursor column segment that includes substantially the size and area of the hollow cross-section, and the sidewall thickness, of first central section 202 extending all the way to a first end of the precursor column segment. The first end of the precursor column segment, i.e., first central section 202, is subsequently joined to the monolithic, unitarily formed casting at a joint 219. For example, joint 219 is formed by welding a free end perimeter of the at least one first sidewall 207 of first central section 202 to an adjoining free end perimeter of the at least one first sidewall 207 of first intermediate section 204 to form joint 219. In alternative embodiments, joint 219 is formed in any suitable fashion that enables first column segment 108 to function as described herein. In some embodiments, first column segment 108 does not include first intermediate section 204, and female end section 206 is formed in a molten metal casting process and affixed directly to first central section 202 at joint 219.

In the exemplary embodiment, the monolithic, unitarily formed casting of female end section 206 and first intermediate section 204 is affixed to first central section 202 at joint 219 prior to delivery of first column segment 108 to site 100, reducing or eliminating a need for welding operations during erection of frame 102 at site 100. In alternative embodiments, the monolithic, unitarily formed casting of female end section 206 and first intermediate section 204 is affixed to first central section 202 at joint 219 at any suitable time.

In some embodiments, female end section 206 and first intermediate section 204 are cast unitarily in a near net shape. In other embodiments, the monolithic, unitarily formed casting of female end section 206 and first intermediate section 204 is subjected to forging, i.e., an application of thermal energy and mechanical energy to the monolithic, unitarily formed casting while the metal remains in a solid state, to obtain the net final shape. In accordance with the casting processes, female end section 206 and first intermediate section 204 (when included) are formed together integrally and therefore monolithic, increasing a structural strength and stability of first column segment 108 at first end 114. In some embodiments, the casting (and forging, when included) process forms female end section 206 and first intermediate section 204 with substantially no material loss from the at least one first sidewall 207, increasing an efficiency of the manufacturing process. In certain embodiments, first fastener openings 212 are machined through the at least one first sidewall 207 along female end section 206 after the casting step is completed but before the monolithic, unitarily formed casting is affixed to first central section 202 at joint 219. In other embodiments, first fastener openings 212 are machined through the at least one first sidewall 207 along female end section 206 after joint 219 is formed.

In some embodiments, forming female end section 206 and first intermediate section 204 using a casting process results in improved structural performance of interface 112, as compared to a similar interface formed by welding female end section 206 and first intermediate section 204 together and/or machining material away from a precursor column segment to shape female end section 206 and/or first intermediate section 204. For example, forming female end section 206 using a casting process integrally increases thickness 214 of the at least one first sidewall 207 along female end section 206 to be greater than thickness 218 of first central section 202, which would not occur for a similar female end section formed by other processes. Additionally or alternatively, forming female end section 206 and first intermediate section 204 using a casting process simplifies a certification process for assembled column 104.

In alternative embodiments, female end section 206 and first intermediate section 204 are formed using a hot-working swaging process. For example, first column segment 108 is formed from a hollow precursor column segment (not shown) that initially includes substantially the size and area of the hollow cross-section, and the sidewall thickness, of first central section 202 extending all the way to a first end of the precursor column segment. A first portion of the at least one first sidewall 207 adjacent to the first end, corresponding to the as-yet-to-be-formed female end section 206 and first intermediate section 204, is inductively or gas-furnace heated and forced into a mandrel and die arrangement (not shown) or mandrel and forming rolls arrangement (not shown). Alternatively, the first portion is heated in any suitable fashion. The mandrel expands the inner cross-section of the first portion to obtain the preselected orientation of interior surface 240 of the at least one first sidewall 207 along female end section 206 and first intermediate section 204, and the die or forming rolls simultaneously shape the outer cross-section of the first portion to obtain the preselected orientation of exterior surface 242 of the at least one first sidewall 207 along female end section 206 and first intermediate section 204. In other embodiments, female end section 206 and first intermediate section 204 are formed using a cold-working swaging process. Alternatively, first column segment 108 does not include first intermediate section 204, and female end section 206 is formed in a swaging process. In accordance with the swaging processes, female end section 206 and first intermediate section 204 (when included) are formed integrally with first central section 202 and therefore monolithic, increasing a structural strength and stability of first column segment 108 at first end 114. In some embodiments, the swaging process forms female end section 206 and first intermediate section 204 with substantially no material loss from the at least one first sidewall 207, increasing an efficiency of the manufacturing process. In certain embodiments, first fastener openings 212 are machined through the at least one first sidewall 207 along female end section 206 after the swaging step is completed.

In some embodiments, forming female end section 206 and first intermediate section 204 using a swaging process results in improved structural performance of interface 112, as compared to a similar interface formed by welding elements together and/or machining material away from a precursor column segment. For example, forming female end section 206 using a swaging process integrally increases thickness 214 of the at least one first sidewall 207 along female end section 206 to be greater than thickness 218 of first central section 202, which would not occur for a similar female end section formed by other processes. Additionally or alternatively, forming female end section 206 and first intermediate section 204 using a swaging process simplifies a certification process for assembled column 104.

In alternative embodiments, female end section 206 and first intermediate section 204 are formed in any suitable fashion that enables interface 112 to function as described herein.

In the exemplary embodiment, second column segment 110 includes at least one second sidewall 257 that extends from second end 120 along longitudinal direction 130 and defines a second cavity 255. In the exemplary embodiment, second cavity 255 extends along an entire length of second column segment 110, and each of first end 118 and second end 120 is open to second cavity 255. Alternatively, second cavity 255 is interrupted along the length of second column segment 110, closed off at first end 118 and/or second end 120, or otherwise extends along less than the entire length of second column segment 110.

In the exemplary embodiment, the at least one second sidewall 257 defines, in longitudinal series from second end 120 along second column segment 110, a second end section 256, a second intermediate section 254, and a second central section 252. In alternative embodiments, at least one additional section is interposed between second intermediate section 254 and second central section 252. In other alternative embodiments, second intermediate section 254 is not included. For example, second end section 256 is directly adjacent to second central section 252. Second end section 256 is also referred to herein as a male end section 256.

In the exemplary embodiment, the at least one second sidewall 257 at interface 112 is configured to be received within, and oriented in substantially face-to-face adjacent relationship with, the at least one first sidewall 207 of first column segment 108 at interface 112. Thus, in the exemplary embodiment of FIGS. 2-4, similar to the at least one first sidewall 207, the at least one second sidewall 257 includes four sidewalls 257 oriented to define a substantially rectangular hollow cross-section, in a plane normal to longitudinal direction 130, at each longitudinal station along second column segment 110. For example, in the illustrated embodiment, the four sidewalls 257 are oriented to define a substantially square hollow cross-section. Alternatively, the at least one second sidewall 257 includes any suitable number of sidewalls 257 and/or is oriented to define any suitable hollow cross-section that enables the at least one second sidewall 257 to be received within, and oriented in substantially face-to-face relationship with, the at least one first sidewall 207. For example, in some embodiments, the at least one second sidewall 257 is a single, curved second sidewall 257 oriented to define a substantially elliptical or circular hollow cross-section at each longitudinal station, as shown in FIG. 5. With reference to FIGS. 2-5, in the exemplary embodiment, a size and area of the hollow cross-section defined by the at least one second sidewall 257 varies among second central section 252, second intermediate section 254, and second end section 256. Also in the exemplary embodiment, the size and area of the hollow cross-section defined by the at least one second sidewall 257 varies along second intermediate section 254 and along second end section 256, and is substantially constant along second central section 252. Alternatively, the size and area of the hollow cross-section defined by the at least one second sidewall 257 are defined along second central section 252, second intermediate section 254, and/or second end section 256 in any suitable fashion that enables interface 112 to function as described herein.

At second end 120, the at least one second sidewall 257 defines a second or male end surface 260 oriented transversely to longitudinal direction 130.

The at least one second sidewall 257 includes an interior surface 290 facing second cavity 255, and an exterior surface 292 facing outwardly opposite interior surface 290. Exterior surface 292 along male end section 256 is oriented to be substantially parallel to, and in substantially face-to-face adjacent relationship with, interior surface 240 of female end section 206 when male end section 256 is received within female end section 206. Thus, exterior surface 292 of the at least one second sidewall 257 along male end section 256 tapers transversely inwardly along male end section 256 towards second end 120 complementarily to the transversely outward taper of interior surface 240 of the at least one first sidewall 207 along female end section 206. For example, in the exemplary embodiment, exterior surface 292 of each second sidewall 257 along male end section 256 is oriented at the non-zero end taper angle 244, as described above and best seen in FIG. 4, with respect to longitudinal direction 130. As described above, in some embodiments, end taper angle 244 is between about 1 degree and about 5 degrees, facilitating the alignment and seating advantages described herein while substantially maintaining a longitudinal load carrying path of column 104. More specifically, in some embodiments, end taper angle 244 is 2 degrees. In alternative embodiments, exterior surface 292 of the at least one second sidewall 257 is tapered inwardly along male end section 256 complementarily to the outward taper of interior surface 240 of the at least one first sidewall 207 along female end section 206 in any suitable fashion that enables interface 112 to function as described herein.

In the exemplary embodiment, interior surface 290 along male end section 256 is oriented substantially parallel to exterior surface 292, such that a thickness 264 of the at least one second sidewall 257 remains constant along male end section 256. In alternative embodiments, interior surface 290 along male end section 256 is oriented in any suitable fashion with respect to exterior surface 292, and/or thickness 264 of the at least one second sidewall 257 varies along male end section 256 to any suitable extent, that enables interface 112 to function as described herein. In the exemplary embodiment, thickness 264 is greater than a thickness 268 of the at least one second sidewall 257 along second central section 252 to facilitate increased structural strength of transverse cross-sections of male end section 256 that include second fastener openings 262.

The at least one second sidewall 257 along male end section 256 includes at least one second fastener opening 262 defined therein and extending therethrough. The at least one second fastener opening 262 is positioned to register with at least one first fastener opening 212 defined in female end section 206 when male end section 256 is received in female end section 206, such that a corresponding at least one fastener 312 is insertable into each pair of aligned fastener openings 212 and 262. Thus, in the exemplary embodiment, the at least one second fastener opening 262 includes a plurality of second fastener openings 262 arranged in a respective second fastener pattern on each sidewall 257 along male end section 256, corresponding to the respective first fastener-patterns on female end section 206. For example, in the exemplary embodiment, each of the four sidewalls 257 includes a plurality of second fastener openings 262 arranged in an identical second fastener pattern. In alternative embodiments, at least one of the four sidewalls 257 includes a plurality of second fastener openings 262 arranged in a second fastener pattern that differs from the second fastener pattern of others of the four sidewalls 257, or includes no second fastener openings 262. In the exemplary embodiment, the second fastener pattern includes six second fastener openings 262 arranged in two rows each having three second fastener openings 262, and each second fastener opening 262 in each row is vertically aligned with a respective second fastener opening 262 in the adjacent row. In alternative embodiments, each second fastener pattern includes any suitable number, arrangement, and/or alignment of second fastener openings 262 configured to register with first fastener openings 212.

In the exemplary embodiment, exterior surface 292 of the at least one second sidewall 257 flares or tapers transversely outwardly along second intermediate section 254 away from second central section 252 towards male end section 256. In some embodiments, exterior surface 292 tapers outwardly to a transversely extending stop surface 258 directly adjacent to male end section 256. More specifically, stop surface 258 extends transversely outwardly from exterior surface 292 along male end section 256 and intersects outwardly tapered exterior surface 292 of second intermediate section 254. In other words, stop surface 258 is defined by exterior surface 292 between second intermediate section 254 and male end section 256.

Stop surface 258 is configured to bear against female end surface 210 in substantially face-to-face contact when male end section 256 is received within female end section 206. Thus, in the exemplary embodiment, stop surface 258 is oriented complementary to female end surface 210, transversely to longitudinal direction 130. In some embodiments, stop surface 258 oriented to bear against female end surface 210 facilitates maintaining proper longitudinal positioning and alignment of male end section 256 with respect to female end section 206 during assembly of column 104, and in particular proper registration of the at least one first fastener opening 212 and the at least one second fastener opening 262 to facilitate insertion of the at least one fastener 312 therethrough.

For example, in the exemplary embodiment, exterior surface 292 of each second sidewall 257 along second intermediate section 254 is oriented at a non-zero second exterior intermediate taper angle 296, as best seen in FIG. 4, with respect to longitudinal direction 130. In some embodiments, second exterior intermediate taper angle 296 is between about 3 degrees and about 30 degrees, facilitating the definition of stop surface 258 adjacent male end section 256 while providing at least a partially longitudinal load path from stop surface 258 into second central section 252. More specifically, in some embodiments, second exterior intermediate taper angle 296 is 10 degrees. In alternative embodiments, the at least one second sidewall 257 is tapered outwardly along second intermediate section 254 towards male end section 256 in any suitable fashion that enables stop surface 258 to function as described herein.

In the exemplary embodiment, interior surface 290 of the at least one second sidewall 257 tapers transversely inwardly along second intermediate section 254 away from second central section 252 towards male end section 256, such that a thickness 266 of the at least one second sidewall 257 is continuously increased along second intermediate section 254 towards male end section 256. For example, in the exemplary embodiment, interior surface 290 of each second sidewall 257 along second intermediate section 254 is oriented at a non-zero second interior intermediate taper angle 298, as best seen in FIG. 4, with respect to longitudinal direction 130. In some embodiments, second interior intermediate taper angle 298 is between about 3 degree and about 30 degrees, facilitating a continuous transition from interior surface 290 of second central section 252 to interior surface 290 along male end section 256, such that stress concentrations are reduced. More specifically, in some embodiments, second interior intermediate taper angle 298 is 10 degrees. In alternative embodiments, interior surface 290 along male end section 256 is oriented in any suitable fashion, and/or thickness 266 of the at least one second sidewall 257 is defined along second intermediate section 254 in any suitable fashion, that enables interface 112 to function as described herein.

In alternative embodiments, second column segment 110 does not include second intermediate section 254. For example, male end section 256 is directly adjacent to second central section 252, and stop surface 258 is defined in any suitable fashion that enables stop surface 258 to interact with female end surface 210 as described herein. Alternatively, second column segment 110 does not include stop surface 258.

In the exemplary embodiment, second central section 252 extends over at least half of a total length of second column segment 110. In alternative embodiments, second central section 252 extends over any suitable portion of the total length of second column segment 110. In the exemplary embodiment, the size and area of the hollow cross-section defined by the at least one second sidewall 257 along second central section 252 is substantially constant. Moreover, a thickness 268 of the at least one second sidewall 257 along second central section 252 is substantially constant. In alternative embodiments, the size and area of the hollow cross-section defined by the at least one second sidewall 257 along second central section 252 and/or thickness 268 vary in any suitable fashion that enables second column segment 110 to function as described herein. In the exemplary embodiment, interior surface 290 and exterior surface 292 of the at least one second sidewall 257 along second central section 252 are oriented substantially parallel to each other and to longitudinal direction 130. In alternative embodiments, interior surface 290 and exterior surface 292 of the at least one second sidewall 257 along second central section 252 are oriented with respect to each other and to longitudinal direction 130 in any suitable fashion that enables second column segment 110 to function as described herein.

In the exemplary embodiment, male end section 256 and second intermediate section 254 are formed together in a molten metal (e.g., steel) casting process, resulting in a monolithic and unitarily formed casting of male end section 256 and second intermediate section 254. For example, second central section 252 is formed separately from a hollow precursor column segment that includes substantially the size and area of the hollow cross-section, and the sidewall thickness, of second central section 252 extending all the way to a second end of the precursor column segment. The second end of the precursor column segment, i.e., second central section 252, is subsequently joined to the monolithic, unitarily formed casting at a joint 269. For example, joint 269 is formed by welding a free end perimeter of the at least one first sidewall 207 of second central section 252 to an adjoining free end perimeter of the at least one first sidewall 207 of second intermediate section 254 to form joint 269. In alternative embodiments, joint 269 is formed in any suitable fashion that enables second column segment 110 to function as described herein. In some embodiments, second column segment 110 does not include second intermediate section 254, and male end section 256 is formed in a molten metal casting process and affixed directly to second central section 252 at joint 269.

In the exemplary embodiment, the monolithic, unitarily formed casting of male end section 256 and second intermediate section 254 is affixed to second central section 252 at joint 269 prior to delivery of second column segment 110 to site 100, reducing or eliminating a need for welding operations during erection of frame 102 at site 100. In alternative embodiments, the monolithic, unitarily formed casting of male end section 256 and second intermediate section 254 is affixed to second central section 252 at joint 269 at any suitable time.

In some embodiments, male end section 256 and second intermediate section 254 are cast unitarily in a near net shape. In other embodiments, the monolithic, unitarily formed casting of male end section 256 and second intermediate section 254 is subjected to forging, i.e., an application of thermal energy and mechanical energy to the monolithic, unitarily formed casting while the metal remains in a solid state, to obtain the net final shape. In accordance with the casting processes, male end section 256 and second intermediate section 254 (when included) are formed together integrally and therefore monolithic, increasing a structural strength and stability of second column segment 110 at second end 120. In some embodiments, the casting (and forging, when included) process forms male end section 256 and second intermediate section 254 with substantially no material loss from the at least one first sidewall 207, increasing an efficiency of the manufacturing process. In certain embodiments, second fastener openings 262 are machined through the at least one first sidewall 207 along male end section 256 after the casting step is completed but before the monolithic, unitarily formed casting is affixed to second central section 252 at joint 269. In other embodiments, second fastener openings 262 are machined through the at least one first sidewall 207 along male end section 256 after joint 269 is formed.

In some embodiments, forming male end section 256 and second intermediate section 254 using a casting process results in improved structural performance of interface 112, as compared to a similar interface formed by welding male end section 256 and second intermediate section 254 together and/or machining material away from a precursor column segment to shape male end section 256 and second intermediate section 254. For example, forming male end section 256 using a casting process integrally increases thickness 264 of the at least one first sidewall 207 along male end section 256 to be greater than thickness 268 of second central section 252, which would not occur for a similar male end section formed by other processes. Additionally or alternatively, forming male end section 256 and second intermediate section 254 using a casting process simplifies a certification process for assembled column 104.

In alternative embodiments, male end section 256 and second intermediate section 254 are formed using a hot-working swaging process. For example, second column segment 110 is formed from a hollow precursor column segment (not shown) that initially includes substantially the size and area of the hollow cross-section, and the sidewall thickness, of second central section 252 extending all the way to a second end of the precursor column segment. A first portion of the at least one second sidewall 257 adjacent to the second end, corresponding to the as-yet-to-be-formed male end section 256 and second intermediate section 254, is inductively or gas-furnace heated and forced into a mandrel and die arrangement (not shown) or mandrel and forming rolls arrangement (not shown). Alternatively, the first portion is heated in any suitable fashion. The mandrel expands the inner cross-section of the first portion to obtain the preselected orientation of interior surface 290 of the at least one second sidewall 257 along male end section 256 and second intermediate section 254, and the die or forming rolls simultaneously shape the outer cross-section of the first portion to obtain the preselected orientation of exterior surface 292 of the at least one second sidewall 257 along male end section 256 and second intermediate section 254. In other embodiments, male end section 256 and second intermediate section 254 are formed using a cold-working swaging process. Alternatively, second column segment 110 does not include second intermediate section 254, and male end section 256 is formed in a swaging process. In accordance with the swaging processes, male end section 256 and second intermediate section 254 (when included) are formed integrally with second central section 252 and therefore monolithic, increasing a structural strength and stability of second column segment 110 at second end 120. In some embodiments, the swaging process forms male end section 256 and second intermediate section 254 with substantially no material loss from the at least one second sidewall 257, increasing an efficiency of the manufacturing process. In certain embodiments, second fastener openings 262 are machined through the at least one second sidewall 257 along male end section 256 after the swaging step is completed.

In some embodiments, forming male end section 256 and second intermediate section 254 using a swaging process results in improved structural performance of interface 112, as compared to a similar interface formed by welding elements together and/or machining material away from a precursor column segment. For example, forming male end section 256 using a swaging process integrally increases thickness 264 of the at least one second sidewall 257 along male end section 256 to be greater than thickness 268 of second central section 252, which would not occur for a similar male end section formed by other processes. Additionally or alternatively, forming male end section 256 and second intermediate section 254 using a swaging process simplifies a certification process for assembled column 104.

In alternative embodiments, male end section 256 and second intermediate section 254 are formed in any suitable fashion that enables interface 112 to function as described herein.

To assemble column 104, such as at the site of and/or during erection of frame 102, first column segment 108 and second column segment 110 are positioned with respect to each other and male end section 256 is inserted into female end section 206. In the exemplary embodiment, the complementary tapering of interior surface 240 of female end section 206 and exterior surface 292 of male end section 256 facilitates guiding and centering male end section 256 as male end section 256 is received within female end section 206. For example, after first column segment 108 is coupled to a suitable base structure (e.g., foundation 122 or another support member of frame 102), second column segment 110 is lowered, for example using crane 124, until male end section 256 is inserted into female end section 206 and second column segment 110 is seated on top of first column segment 108. Moreover, in the exemplary embodiment, second column segment 110 is lowered until stop surface 258 contacts and bears against complementary female end surface 210, at which stage the at least one second sidewall 257 is oriented in adjacent, substantially face-to-face relationship with the corresponding at least one first sidewall 207 and the at least one first fastener opening 212 is registered with the corresponding at least one second fastener opening 262. Thus, forming second column segment 110 to include stop surface 258 facilitates proper final longitudinal positioning of second column segment 110 and proper alignment of the at least one first fastener opening 212 and the at least one second fastener opening 262. After second column segment 110 is seated on first column segment 108, the at least one fastener 312 (for example, a blind bolt) is then inserted into the registered first and second fastener openings. Upon tightening of fasteners 312, lateral, rotational, and axial movement of second column segment 110 relative to first column segment 108 is inhibited. In some embodiments, interface 112 is assembled without any welding of first column segment 108 to second column segment 110, and without any on-site welding of connector plates (not shown) to first column segment 108 and/or second column segment 110 at interface 112.

In alternative embodiments, male end section 256 and female end section 206 are secured to assemble column 104 in any suitable fashion. It is understood that the orientation of the column segments may be reversed so that female end section 206 is lowered onto and around male end section 256, first column segment 108 is seated atop second column segment 110, and so forth.

In some embodiments, first end 118 of second column segment 110 includes another first intermediate section 204 and female end section 206, opposite second intermediate section 254 and male end section 256 at second end 120, to facilitate addition of another column segment (not shown) atop second column segment 110 in similar fashion. Additionally or alternatively, second end 116 of first column segment 108 includes another male end section 256 opposite first intermediate section 204 and female end section 206 at first end 114, and foundation 122 includes another female end section 206 to facilitate assembly of first column segment 108 atop foundation 122. In some embodiments, column segments 108 and 110 are formed as a plurality of identical column segments each having first intermediate section 204 and female end section 206 at one end and second intermediate section 254 and male end section 256 at an opposite end, facilitating interchangeable use of column segments in frame 102.

In some embodiments, interface 112 also facilitates a step-down in a width of column 104 from first column segment 108 to second column segment 110. More specifically, a first segment width 230 of first central section 202 of first column segment 108 is greater than a second segment width 280 of second central section 252 of second column segment 110. For example, in some embodiments, first segment width 230 is 20 inches and second segment width 280 is 18 inches. For another example, in some embodiments, first segment width 230 is 12 inches and second segment width 280 is 10 inches. For another example, in some embodiments, first segment width 230 is 8 inches and second segment width 280 is 6 inches. Such step-downs in the width of column 104 are consistent with a reduced weight and moment load on upper portions of frame 102 as compared to lower portions of frame 102. In alternative embodiments, first segment width 230 and second segment width 280 are substantially equal.

The methods and systems described herein facilitate erecting a moment-resisting frame at a building site. More specifically, the methods and systems facilitate coupling column segments together onsite using a tapered interface that is integral to the column segments. The tapered interface facilitates alignment and seating of a male end section of one column within a female end section of an adjacent column during assembly of the interface, while substantially maintaining a longitudinal load carrying path of the column. The methods and systems further facilitate eliminating the time that would otherwise be required to weld column segments to one another and/or to a connector between the column segments. As such, the methods and systems facilitate transporting longer columns to a building site in segments, and assembling the columns at the building site by coupling the associated column segments together using a moment-resisting interface that is strictly mechanical in nature. As such, the methods and systems facilitate reducing the time and cost associated with erecting a multistory, moment-resisting frame at a building site.

Exemplary embodiments of connecting interfaces and methods of assembling the same are described above in detail. The methods and systems described herein are not limited to the specific embodiments described herein, but rather, components of the methods and systems may be utilized independently and separately from other components described herein. For example, the methods and systems described herein may have other applications not limited to practice with frames of buildings, as described herein. Rather, the methods and systems described herein can be implemented and utilized in connection with various other industries.

While the disclosure has been described in terms of various specific embodiments, those skilled in the art will recognize that the disclosure can be practiced with modification within the spirit and scope of the claims.

What is claimed is:

1. An interface for a structural column, said interface comprising:

a female end section comprising at least one first sidewall that extends from a first end along a longitudinal direction and defines a first cavity, said at least one first sidewall comprising an interior surface facing said first cavity and an exterior surface facing outwardly opposite said interior surface of said at least one first sidewall, wherein said exterior surface along female end section is oriented substantially parallel to said interior surface of said at least one first sidewall along said female end section, wherein said interior surface of said at least one first sidewall tapers transversely outwardly along said female end section towards said first end, wherein said at least one first sidewall further defines a first intermediate section, wherein said interior surface of said at least one first sidewall tapers transversely outwardly along said first intermediate section away from said female end section, and wherein said exterior surface along said first intermediate section extends parallel to said exterior surface along said female end section; and a male end section comprising at least one second sidewall that extends from a second end along the longitudinal direction and defines a second cavity, said at least one second sidewall configured to be received within, and oriented in substantially face-to-face adjacent relationship with, said at least one first sidewall, said at least one second sidewall comprising an interior surface facing said second cavity and an exterior surface facing outwardly opposite said interior surface, wherein each of said female end section and said male end section comprises a respective unitary casting, and wherein each of said at least one first sidewall and said at least one second sidewall define a rectangular cross-section in a plane normal to the longitudinal direction.

2. The interface in accordance with claim 1, wherein said interior surface of said first sidewall along said female end section is oriented at an end taper angle between 1 degree and 5 degrees.

3. The interface in accordance with claim 1, wherein said at least one first sidewall further comprises a female end surface at said first end, said female end surface oriented transversely to the longitudinal direction, said interface further comprising a second intermediate section defined by said at least one second sidewall, wherein said exterior surface of said at least one second sidewall defines a stop surface between said second intermediate section and said male end section, said stop surface configured to bear against said female end surface in substantially face-to-face contact when said male end section is received within said female end section.

4. The interface in accordance with claim 3, wherein said exterior surface of said at least one second sidewall along said second intermediate section is oriented at a second exterior intermediate taper angle between 3 degrees and 30 degrees.

5. The interface in accordance with claim 4, wherein said second intermediate section and said male end section are integrally formed and monolithic.

6. The interface in accordance with claim 4, wherein said interior surface of said at least one second sidewall tapers transversely inwardly along said second intermediate section towards said male end section, such that a thickness of said at least one second sidewall is continuously increased along said second intermediate section towards said male end section.

7. The interface in accordance with claim 1, wherein said first intermediate section and said female end section are integrally formed and monolithic.

8. A structural member for a moment-resisting frame, said structural member comprising:

a first hollow segment comprising at least one first sidewall that extends along a longitudinal direction from a first end to a second end and defines a first cavity, said at least one first sidewall comprising an interior surface facing said first cavity and an exterior surface facing outwardly opposite said interior surface of said at least one first sidewall, wherein said exterior surface along female end section is oriented substantially parallel to said interior surface of said at least one first sidewall along said female end section, wherein said at least one first sidewall further defines a female end section extending longitudinally along said first hollow segment from said first end of said first hollow segment, said interior surface of said at least one first sidewall tapers transversely outwardly along said female end section towards said first end of said first hollow segment, wherein said at least one first sidewall further defines a first intermediate section, wherein said interior surface of said at least one first sidewall tapers transversely outwardly along said first intermediate section away from said female end section, and wherein said exterior surface along said first intermediate section extends parallel to said exterior surface along said female end section; and a second hollow segment comprising at least one second sidewall that extends along the longitudinal direction from a first end to a second end and defines a second cavity, said at least one second sidewall comprising an interior surface facing said second cavity and an exterior surface facing outwardly opposite said interior surface of said at least one second sidewall, wherein said at least one second sidewall further defines a male end section extending longitudinally along said second hollow segment from said second end of said second hollow segment, wherein each of said female end section and said male end section comprises a respective unitary casting, and wherein each of said at least one first sidewall and said at least one second sidewall define a rectangular cross-section in a plane normal to the longitudinal direction.

9. The structural member in accordance with claim 8, wherein said interior surface of said first sidewall along said female end section is oriented at an end taper angle between 1 degree and 5 degrees.

10. The structural member in accordance with claim 8, wherein said at least one first sidewall further comprises a female end surface at said first end, said female end surface oriented transversely to the longitudinal direction, said second hollow segment further comprising a second intermediate section defined by said at least one second sidewall, wherein said exterior surface of said at least one second sidewall defines a stop surface between said second intermediate section and said male end section, said stop surface and said female end surface being in substantially face-to-face contact.

11. The structural member in accordance with claim 10, wherein said second hollow segment further comprises a second central section defined by said at least one second sidewall, wherein a cross-section defined by said at least one second sidewall is substantially constant along said second central section, and wherein said exterior surface of said at least one second sidewall tapers transversely outwardly along said second intermediate section away from said second central section to said stop surface.

12. The structural member in accordance with claim 11, wherein said male end section, said second intermediate section, and said second central section are integrally formed and monolithic.

13. The structural member in accordance with claim 8, wherein said first hollow segment further comprises a first central section defined by said at least one first sidewall, wherein a cross-section defined by said at least one first sidewall is substantially constant along said first central section, and wherein said female end section, said first intermediate section, and said first central section are (i) arranged longitudinally in series along said first hollow segment and (ii) integrally formed and monolithic.

14. A method of assembling a structural column, said method comprising:

positioning a first column segment and a second column segment with respect to each other, wherein:

the first column segment includes at least one first sidewall that extends along a longitudinal direction from a first end to a second end and defines a first cavity, the at least one first sidewall including an interior surface facing the first cavity, wherein the at least one first sidewall further defines a female end section extending longitudinally along the first column segment from the first end of the first column segment, the female end section being unitarily cast, the at least one first sidewall defines a rectangular cross-section in a plane normal to the longitudinal direction, the interior surface of the at least one first sidewall tapers transversely outwardly along the female end section towards the first end of the first HSS column segment, and the second column segment includes at least one second sidewall that extends along the longitudinal direction from a first end to a second end and defines a second cavity, the at least one second sidewall including an interior surface facing the second cavity and an exterior surface facing outwardly opposite the interior surface of the at least one second sidewall, wherein the at least one second sidewall further defines a male end section extending longitudinally along the second HSS column segment from the second end of the second HSS column segment, the male end section being unitarily cast, the at least one second sidewall defines a rectangular cross-section in a plane normal to the longitudinal direction;

inserting the male end section into the female end section such that the at least one second sidewall is oriented in adjacent, substantially face-to-face relationship with the at least one first sidewall and at least one first fastener opening defined in the at least one first sidewall is registered with a corresponding at least one second fastener opening defined in the at least one second sidewall; and inserting at least one fastener into the registered first and second fastener openings.

15. The method in accordance with claim 14, wherein said inserting the male end section into the female end section further comprises inserting the male end section until a stop surface defined on the exterior surface of the at least one second sidewall bears against a female end surface defined at the first end of the at least one first sidewall.

16. The method in accordance with claim 14, wherein said inserting the male end section into the female end section further comprises inserting the male end section having the exterior surface of the second sidewall oriented at an end taper angle between 1 degree and 5 degrees.

* * * * *